US005704194A

United States Patent [19]

Niehaus

[11] Patent Number: 5,704,194

[45] Date of Patent: Jan. 6, 1998

[54] PROCESS AND APPARATUS FOR APPLYING WRAPPED PACKAGES TO CUPS

[75] Inventor: Richard J. Niehaus, County of St. Louis, Mo.

[73] Assignee: Fleming Printing Company, Fenton, Mo.

[21] Appl. No.: 601,578

[22] Filed: Feb. 14, 1996

[51] Int. Cl.[6] ..... B65B 61/00

[52] U.S. Cl. ..... 53/415

[58] Field of Search ..... 53/410, 415, 135.1, 53/135.2, 128.1, 129.1; 414/795.1, 795.6, 797.7, 788.4, 798.4, 798.5; 156/521, 563, 567, 568, 571, 295

[56] References Cited

U.S. PATENT DOCUMENTS

| | | | |
|---|---|---|---|
| 2,756,864 | 7/1956 | Laxo . | |
| 3,587,816 | 6/1971 | Russell . | |
| 3,661,075 | 5/1972 | Amberg . | |
| 3,661,282 | 5/1972 | Buhayer et al. | 214/152 |
| 3,791,894 | 2/1974 | Mistarz | 156/567 |
| 3,903,676 | 9/1975 | Kinney | 53/314 |
| 3,981,407 | 9/1976 | Potts . | |
| 4,052,250 | 10/1977 | Potts . | |
| 4,109,572 | 8/1978 | Roulleau . | |
| 4,260,311 | 4/1981 | Hanses . | |
| 4,443,285 | 4/1984 | Roth et al. . | |
| 4,500,386 | 2/1985 | Hoffman | 156/568 |
| 4,555,299 | 11/1985 | Voltmer et al. . | |
| 4,605,459 | 8/1986 | Voltmer et al. . | |
| 4,707,965 | 11/1987 | Becker | 53/410 |
| 4,872,939 | 10/1989 | McVay et al. | 156/354 |
| 4,931,122 | 6/1990 | Mitchell . | |
| 5,045,140 | 9/1991 | Dickey . | |
| 5,064,093 | 11/1991 | Davis et al. | 414/797.7 |
| 5,133,169 | 7/1992 | Tesch, Jr. et al. | 53/247 |
| 5,163,073 | 11/1992 | Chasteen et al. . | |
| 5,538,575 | 7/1996 | Hinton | 156/568 |

*Primary Examiner*—John Sipos
*Assistant Examiner*—Ed Tolan
*Attorney, Agent, or Firm*—Polster, Lieder, Woodruff & Lucchesi, L.C.

[57] ABSTRACT

A method and apparatus are disclosed for applying wrapped packages to each cup associated with a nested stack of cups. The stack of cups is continuously fed through a channel defined by a conveyor belt assembly and a pair of rotatable cylindrical rollers having helical continuous grooves formed therein along a fixed path without rotating the cups. The cups are partially denested by the rollers to expose a package receiving surface of each cup. A rotatable applicator assembly retrieves a wrapped packages from a holding bin and applies the package to then exposed package receiving surface of each cup. The packages are removably secured to the cups by an adhesive applied between the package and the package receiving surface of each cup prior to the application of the package to the cup. The wrapped package is urged into engagement with the package receiving surface of each cup by a package compression device. The cups are renested as the cups exit the channel such that the package is held in compressive communication the cup. The nested cups are then packaged and shipped to the desired location.

7 Claims, 4 Drawing Sheets

PROCESS AND APPARATUS FOR APPLYING WRAPPED PACKAGES TO CUPS

BACKGROUND OF THE INVENTION

This invention relates to packaging equipment, and in particular to an apparatus and method for rapidly applying wrapped packages, such as wrapped trading cards, to the outside off frustoconical containers.

In an attempt to generate increased sales, many retailers such as fast food restaurants, gas stations, movie theaters and other entertainment venues often host contests or provide free souvenirs to customers when they purchase products. Some contests include game pieces, literature, or instant winner scratch off cards which are affixed to food containers such as soft drink cups or buckets of popcorn. Souvenirs such as stickers or trading cards depicting athletes or movie characters are also distributed to customers in a similar manner. Since the game piece or souvenir may be damaged by an employee or packaging equipment during shipment or handling or by the customer when it is removed from the container, it is often preferable to place the souvenir or game piece within a wrapped package prior to affixing it to the container.

Application of wrapped packages to the containers at packaging facilities previously has been slow and costly. A problem exists in establishing an apparatus or method for use at a packaging facility that allows for such wrapped packages to be quickly, expeditiously and securely attached to the containers on an automated basis. Therefore, it is desirable to develop an automated apparatus and method that allows for rapidly applying wrapped packages to any frustoconical container. It is further desirable to develop an automated system that requires no special handling of the containers at the packaging facility. Since such frustoconical containers are typically nested together for shipment to reduce the shipping volume, it is desirous for the apparatus to receive the nested containers prior to their packaging for shipment, partially denest the containers, apply the wrapped packages to the containers, and then renest the containers for shipment.

SUMMARY OF THE INVENTION

Accordingly, one object of the present invention is to provide a new and improved apparatus and method for rapidly applying wrapped packages to a frustoconical container.

Another object of this invention is to provide an apparatus and method for rapidly applying wrapped packages to frustoconical containers having means for automatically feeding and advancing into the apparatus a stack of nested containers so that the apparatus partially denests the containers, applies the wrapped packages to the containers, and then renests the containers for shipment.

Another object of this invention is to provide an apparatus and method for rapidly applying wrapped packages to frustoconical containers that is adapted to accomplish secure application of wrapped packages to the containers by applying an adhesive to either a package receiving surface of the container or to the container receiving surface of the package.

Still another object of this invention is to provide an apparatus for rapidly applying wrapped packages to frustoconical containers having means to compressively communicate and affix the wrapped package to the container during adhesive set.

Another object of this invention is to provide an apparatus and method for rapidly applying wrapped packages to frustoconical containers that is highly reliable in operation, safe and easily maintained.

Yet another object of this invention is to provide an apparatus and method for rapidly applying wrapped packages to frustoconical containers that does not require special operator skills or training for operation.

Still another object of this invention is to provide an apparatus and method for applying wrapped packages to frustoconical containers which can be inserted into a conventional container printing line prior to final packaging of the nested containers.

These and other objects and advantages will become apparent to those skilled in the art in light of the following disclosure and accompanying drawings.

In accordance with the invention, generally stated, an apparatus for high speed application of a wrapped package to each of a plurality of frustoconical containers that are normally maintained in a fully nested position is disclosed that includes means for storing a supply of wrapped packages. The apparatus further includes rotatable applicator means. The rotatable applicator means includes a base mounted for rotation in a first direction and a plurality of individually rotatable members positioned on the base for rotation in an opposite direction. Suction means associated with each the member are aligned with the wrapped packages for detachably engaging a wrapped package and applying the wrapped package to an exterior side wall package receiving surface associated with the frustoconical container.

The apparatus also includes a conveyor belt assembly for continuously feeding the containers in rapid succession past the suction means along a longitudinal feed path. Means is provided for partially denesting the containers prior to application of the wrapped package to the container. Means is further provided for renesting the containers after the wrapped package is removably secured to each container. The apparatus also includes means for applying an adhesive between the package and the package receiving surface of the container when each container is partially denested and prior to the application of the package to the container. Means is further provided for applying a compressive force to the wrapped package after the package is attached to the container as the adhesive sets.

Another aspect of the present invention is of an apparatus for high speed application of a wrapped package to an exterior package receiving side wall associated with a frustoconical container by feeding a plurality of nested containers therethrough. The apparatus includes a holding bin for holding and downwardly supplying successively from a pile of wrapped packages the bottom package of the pile. A substantially flat disk is mounted for rotation in a first direction. A plurality of arms individually rotatable in an opposite direction extend outwardly from a first side of the disk parallel to the axis of rotation of the rotating disk. The rotation of each arm is synchronized with respect to the other arms and with respect to the rotation of the disk. Suction means extend radially outwardly from the outermost end of each rotatable arm. The suction means are provided for detachably engaging the bottom wrapped package from the holding bin, and applying the wrapped package to the package receiving surface associated with the frustoconical container.

A conveyor belt assembly is provided for continuously feeding the containers in rapid succession past the suction means along a feed path. The rate at which the containers are fed along the feed path is synchronized with respect to the rotational speeds of the disk and the arms so that a wrapped package is applied by the suction means to each container as the container passes through the apparatus. A pair of threaded cylindrical rollers are disposed along the feed path so as to define a channel therebetween for receiving and confining the containers as the containers are fed through the channel. The rollers have uniform helical grooves formed therein for engaging each container as the containers pass through the channel, and partially denesting the containers prior to application of the wrapped package to the container, and renesting the containers after the wrapped package is removably secured to each container. The apparatus also includes means for applying an adhesive between the package and the package receiving surface of each wrapped package after the package is detachably engaged by the suction means and before the wrapped package is applied to the package receiving surface of the container. Means is provided for preventing lateral movement of the container when the wrapped package is applied to the package receiving surface of the container. Means is further provided for applying a compressive force to the wrapped package after the package is attached to the container as the adhesive sets.

Yet another aspect of the present invention is that of a method for applying wrapped packages to each cup associated with a nested stack of cup, comprising the steps of:

- feeding the stack of cups through a channel so that an exterior side wall package receiving surface of each cup is maintained in a relatively upright position as the cup passes through the channel;
- partially denesting the cups to expose the package receiving surface of each cup;
- retrieving a wrapped package from a pile of wrapped packages;
- applying adhesive between the wrapped package and the package receiving surface of the cup;
- transferring the wrapped package into alignment with the package receiving surface of the cup;
- removably securing the wrapped package to the package receiving surface of the cup;
- applying compressive force to the wrapped package after the wrapped package is applied to the cup; and
- renesting the cups.

Still another aspect of the present invention is that of a method for applying wrapped packages to each cup associated with a nested stack of cups, comprising the steps of:

- continuously feeding the stack of cups along a fixed path without rotating the cups;
- partially denesting the cups to expose a portion of the outer surface of each cup;
- applying adhesive and a wrapped package to the exposed outer surface of each cup;
- urging the wrapped package into engagement with the cup surface; and
- renesting the cups.

Other objects and features will be apparent and in part pointed out hereinafter.

BRIEF DESCRIPTION OF THE DRAWINGS

The objects of the invention are achieved as set forth in the illustrative embodiments shown in the drawings which form a part of the specification.

Corresponding reference characters indicate corresponding parts throughout the several views of the drawings.

DESCRIPTION OF THE PREFERRED EMBODIMENT

Figure 5:
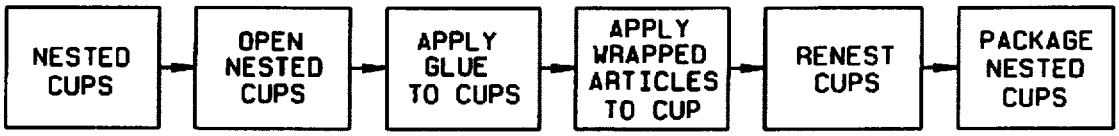
FIG. 5 is a schematic block flow diagram showing the steps of the method used to apply wrapped packages successively to the cups of the present inventor.

FIGS. 1–4 show an apparatus which is used in this invention. FIG. 5 is a schematic block flow diagram which shows the steps of the method used to apply wrapped articles successively to frustoconical containers prior to them being placed into packages for shipment.

Referring first to FIG. 5, the general method involves the steps of starting with a stack of nested printed plastic frustoconical cups; separating the cups by partially denesting by passing the stack through denesting rollers to expose an outer side wall on each cup; applying a spot of adhesive to the exposed side wall or alternatively to a wrapped article to be adhered to the container side wall; removing a wrapped article from a stack of such articles; placing the article on the glue spot on the container, or if the glue is placed on the article, placing the glue spot on the article on the container; renesting the containers to hold the article firmly in place on the cup while the glue dries; and packing the renested containers for shipment.

Figure 1:
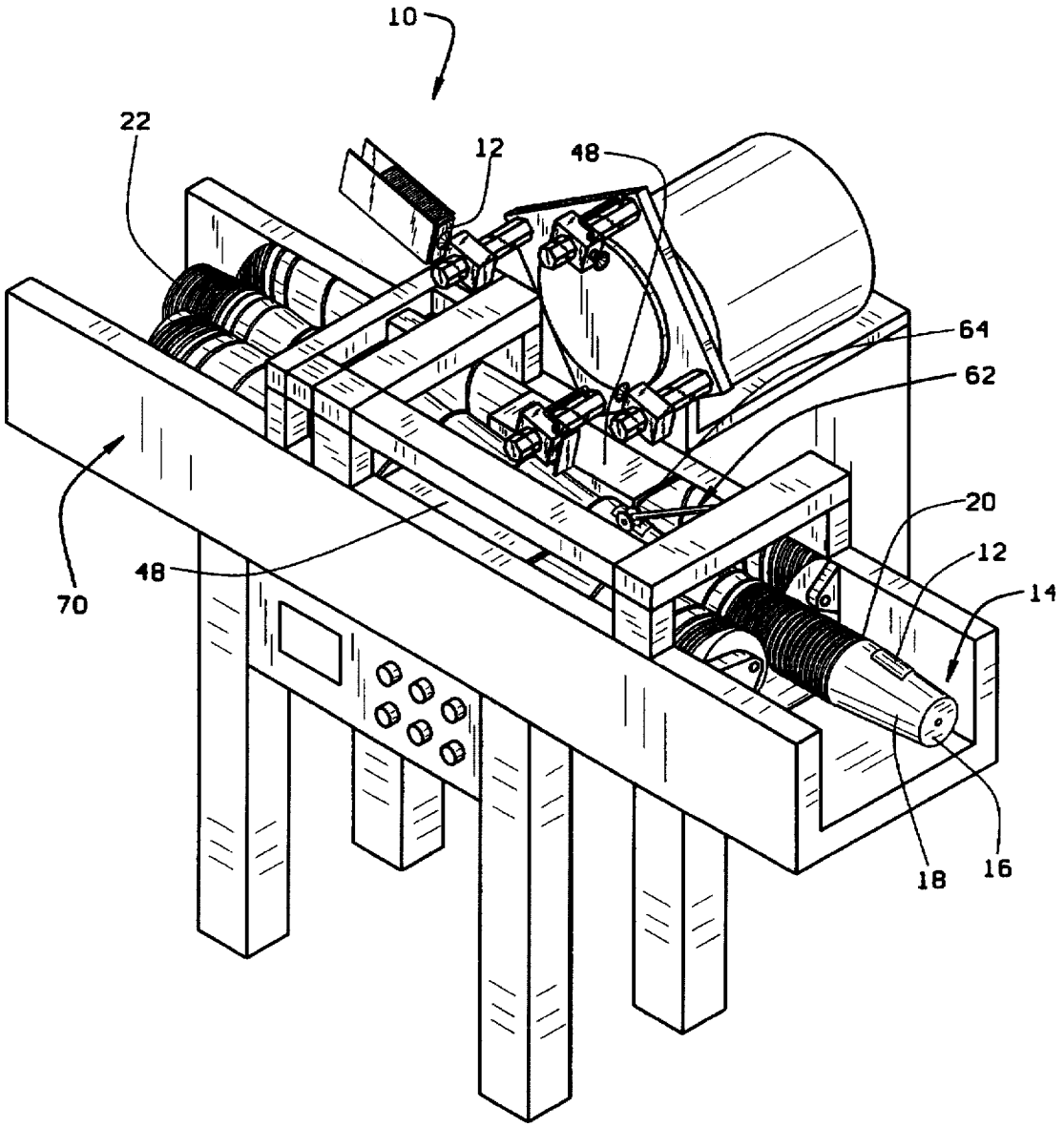
FIG. 1 is a perspective view of an apparatus of the present invention for applying wrapped packages to cups.

Referring now to FIG. 1, there is shown the apparatus, indicated generally at 10, for rapidly applying a wrapped package 12 to each of a plurality of frustoconical containers 14 such as cups. The contents of the wrapped package 12 can include, for example, trading cards, stickers, game pieces, literature or the like that are disposed within a disposable wrapping, such as plastic or cellophane, where the wrapping is discarded when the package 12 is opened. The wrapping can be transparent or opaque, and provides protection for the contents during shipping and handling of the container 14.

The basic structure of the cups 14 is well know, and includes a base 16, a frustoconical side wall 18 extending upwardly from the base 16, and a radially extending rim 20 integrally formed with the upper circumference of the side wall 18 so as to define an opening 22 into which a beverage may be poured. Each side wall 18 has an external side wall package receiving surface 24 onto which one of the wrapped packages 12 is removably secured by the apparatus 10. Any type of wrapped package 12 can be used in conjunction with the present invention provided that it is substantially flat and sufficiently pliable so as to generally conform to the shape of the cup side wall 18 when the cups 14 are renested position after the packages 12 are secured to the cups 14. While this invention is discussed in terms of its application with respect to cups 14, it will be appreciated that any similarly constructed frustoconical container 14, such as a can or shell, can be used in conjunction with the method and apparatus 10 of my present invention.

As will be explained in detail hereinafter and shown in FIGS. 2 and 3, the apparatus 10 includes several individual stations at which steps of the process are performed. These include an input conveyor I which moves a stack of nested cups 14 from a prior step in the processing, such as a printing step, if the apparatus 10 is installed in an existing processing line, or it may be the initial station if the apparatus 10 is free standing and operating on cups previously processed elsewhere. A second station includes a denesting conveyor device II which partially separates the nested cups 14 to expose a package receiving surface 24 on each said cup 14. A third station III is a glue applicator station, and is where a spot of adhesive is applied to each cup package receiving surface 24.

A fourth station is an article applicator station IV where a wrapped article 12 is removed from a supply of such articles and moved into engagement with the glue spot on the cup surface 24. A final station V is a cup renesting station where the cups 14 with the articles 12 attached are renested into a nested stack, and the articles are held in position on the cup surface 24 until the adhesive has dried.

Figure 2:
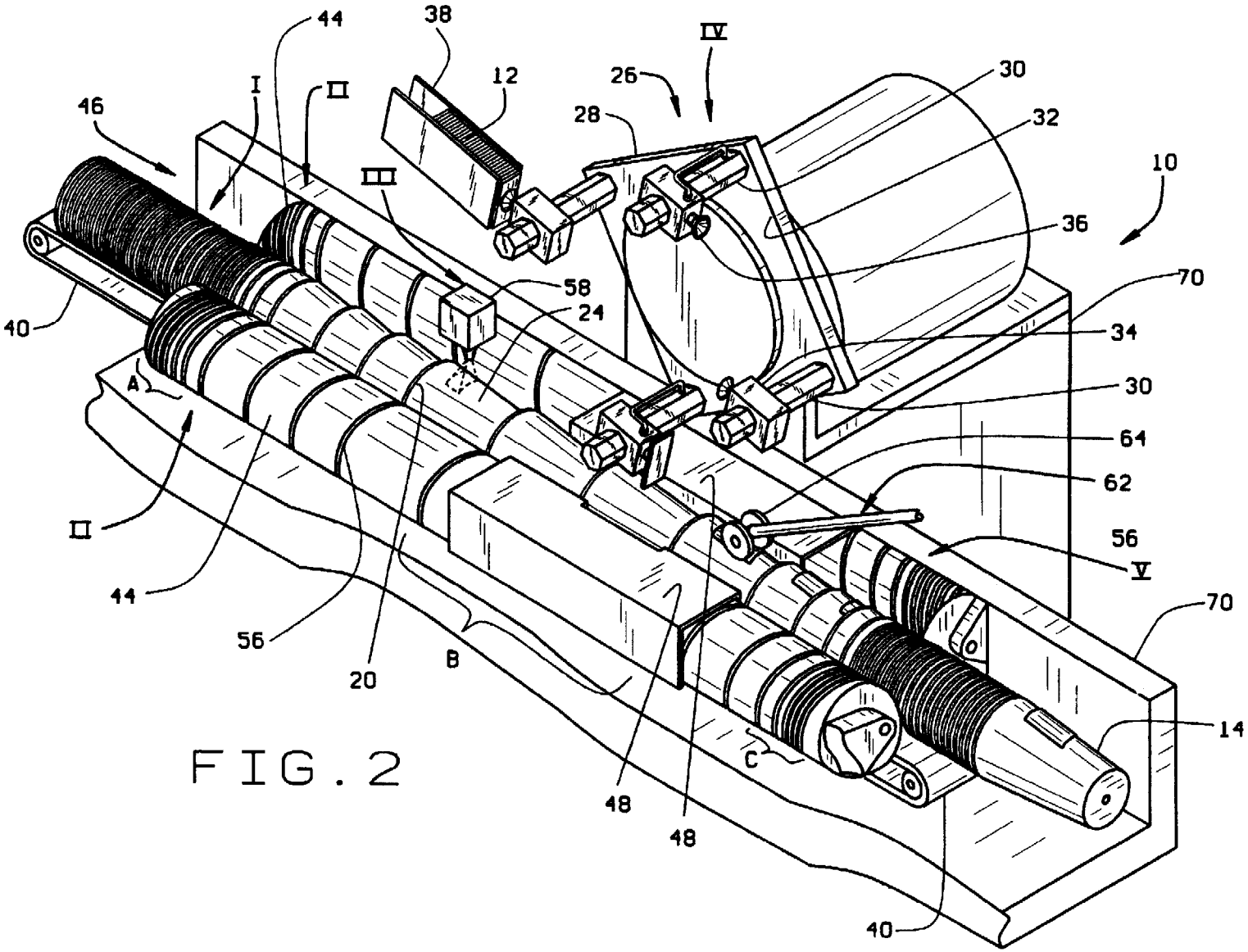
FIG. 2 is a sectional view of the apparatus of FIG. 1 with a portion of the support structure removed to illustrate the process for applying the packages to the cups.

The article applicator station IV includes a high speed rotatable applicator assembly 26 having a substantially flat, rectangular, rotatable base disk 28 with a plurality of individually rotatable arms 30 positioned at the four corners of the base 28 and extending outwardly from a first side 32 of the disk 28 in a perpendicular fashion with respect to the base disk 28 as shown in FIGS. 1 and 2. In the preferred embodiment, four arms extend outwardly from the rotatable disk. The axis of rotation of each arm 30 is parallel to the axis of rotation of the disk 28. When the apparatus is activated, the disk 28 rotates in a first or clockwise direction, while the arms 30 rotate in a relatively opposite or counterclockwise direction as shown in FIG. 3. As will be discussed below, the relative speeds of rotation for the disk 28 and the arms 30 are variable and synchronized. Furthermore, the rotation of each arm 30 is also synchronized with respect to the other rotating arms.

Figure 3:
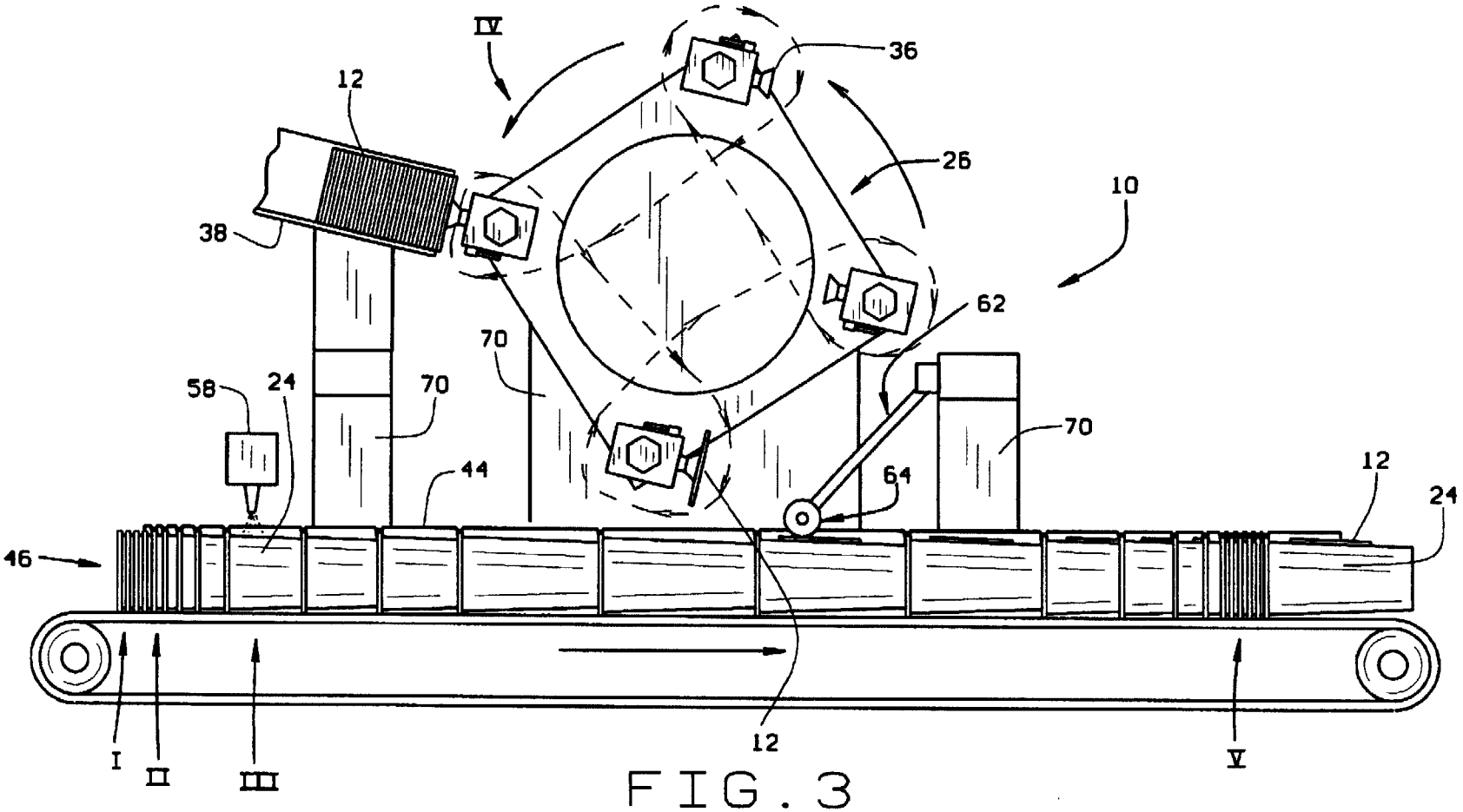
FIG. 3 is a sectional side view of the apparatus shown in FIG. 1 illustrating the relative movement of the rotatable base disk, the suction devices, and the conveyor belt assembly.
Figure 4:
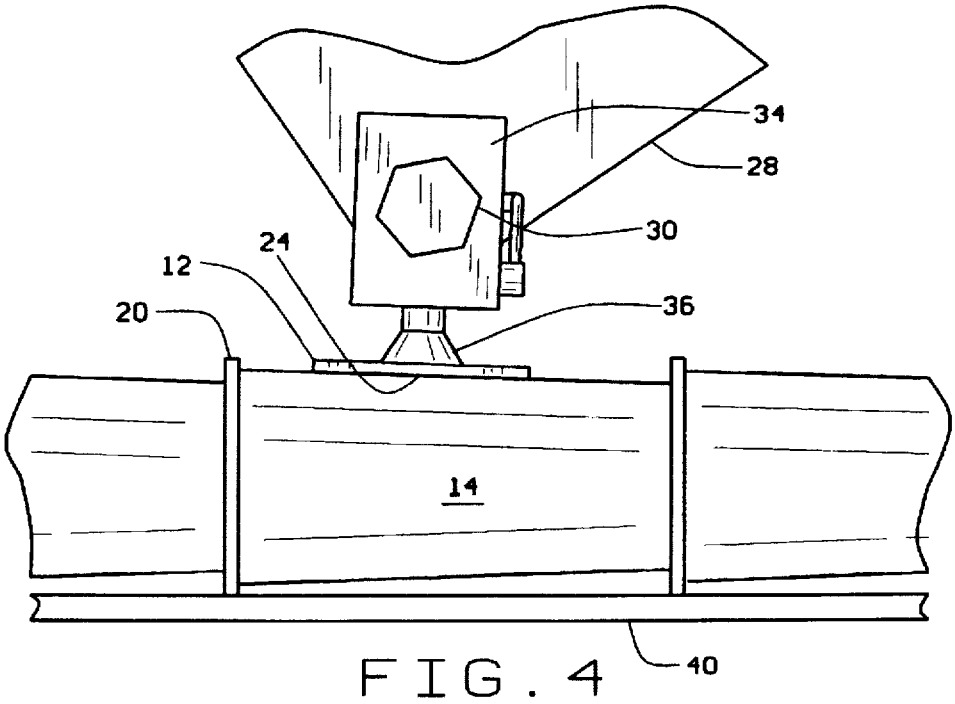
FIG. 4 is a sectional view of the apparatus shown in FIG. 3 illustrating the application of the wrapped package to the cup by the suction device.

A bracket in the form of a rectangular block 34 is securely mounted in close proximity to the distal end of each arm 30 in a perpendicular fashion as shown in FIGS. 1–4. The bracket 34 is fixed on the arm 30 and rotates therewith. Each block 34 has a suction device or applicator 36 that extends radially outwardly from one end of the block 34 with respect to the axis of rotation of the arm 30. The suction device 36 is aligned with a holder 38 which retains a stack or wrapped articles 12. The suction dispenser is designed for detachably engaging the wrapped packages 12 stored in the holding bin 38, and transferring the wrapped packages 12 into alignment with the package receiving surface 24 of the cups 14. As shown in FIGS. 1–3, the holding bin 38 holds and downwardly supplies successively from a stack of wrapped packages the bottom package 12 of the pile. The holding bin 38 is positioned so that the bottom package of the pile is detachably engaged by the suction device 36 as each suction device 36 passes the holding bin 38 upon rotation of the rotatable conveyor and applicator assembly 26. When the wrapped package 12 is properly aligned with the package receiving surface 24 of the cup 14 (FIG. 4), the package 12 is released from the suction device 36 and removably secured to the container 14 by adhesive previously applied to the container 14.

The apparatus 10 also includes a conveyor belt assembly 40 that supports a bottom surface of each cup 14, and continuously feeds the cups 14 in rapid succession past the rotatable applicator assembly 26. The rate at which the cups 14 are fed past the rotating assembly 26 is controlled and synchronized with respect to the rotational speed of the rotating assembly 26.

A pair of threaded rollers 44 are disposed along the longitudinal sides of the conveyor belt assembly 40 so as to define a channel 46 therebetween for receiving and confining the cups 14 as the cups are fed through the channel 46 in a uniform manner (see FIG. 2). The rollers 44 are mounted for synchronized rotation about individual parallel axes of rotation. The axes of rotation for the rollers 44 are preferably spaced equidistant from a central axis defining the channel 46. The position of the rollers 44 with respect to the central axis of the channel 46 can be adjusted to accommodate containers 14 having various diameters.

The rollers 44 employed in the present invention are commercially available, and designed such that each roller 44 includes a helical groove 56 formed therein for engaging the rim 20 of the cup 14. The cups 14 enter and exit the channel 46 in a fully nested position. The spacing between the consecutive windings of the helical groove 56 gradually increases in an identical fashion from a minimum separation distance (region A) to a maximum separation distance (region B) in the midsection of the rollers 44 and then gradually decreases back to the minimum separation distance (region C).

As the cups 14 pass through the channel 46, the cups 14 are maintained in a fully nested position in Station II as they pass along the windings separated by the minimum separation distance (region A), and then gradually partially denested in Stations III and IV so as to fully expose a package receiving surface 24 of each cup 14 as the cup 14 passes along the windings separated by the maximum separation distance (region B). The wrapped package 12 is applied to the cup 14 by the suction device 36 associated with the rotatable conveyor assembly 26 when the package receiving surface 24 of the cup 14 is fully exposed.

As shown in FIGS. 1 and 2, a pair of separators **48*a* and 48*b* are provided in region B to prevent lateral movement of the cups when a wrapped package is applied to each cup. Each separator 48*a*, 48*b* includes a relatively horizontal surface extending from a support frame 70 (discussed below) over the rollers 44 and a vertical surface extending downwardly from the horizontal surface partially between the rollers 44 and the cups in region B to prevent lateral movement of the cups. The separator 48*a* positioned opposite the rotatable applicator assembly 26 has a opening or indentation 50 formed therein to allow for passage of the rotatable arms 30** therethrough.

After the wrapped package 12 is secured to the package receiving surface 24, the cups 14 are then gradually renested in Station V so as to be maintained in a fully nested position as the cups 14 exit the channel 46 (region C). The package receiving surface 24 of each cup 14 is maintained in a relatively upright position at all times as the cup 14 passes through the channel 46. In other words, the cups 14 do not rotate as they pass through the channel 46.

At Station III an adhesive applicator 58 applies a suitable adhesive either to the package receiving surface 24 of the cups 14 as the cups are gradually partially denested and prior to the application of the wrapped package 12 thereto at Station IV (as shown in FIGS. 2 and 3), or to a cup receiving surface 60 of the wrapped package 12 after the package 12 is removed from the holding bin 38 by the suction device 36 and prior to the application of the package 12 to the cup 14 (not shown). In the preferred embodiment, the adhesive used is a latex adhesive. When the wrapped package 12 is later removed by the customer, the adhesive adheres to the packaging so that the adhesive does not mar the exterior surface of the cup 14 or the contents of the package 12.

The rotation of the arms 30 and disk 28 are synchronized with respect to each other and with respect to the feed rate of the cups 14 through the channel 46 so that the wrapped package 12 is released by the suction device 36 and secured by the adhesive to each cup 14 as the cup 14 passes through region B when the package receiving surface 24 of the cup 14 is fully exposed. After the wrapped package 12 is applied to the cup 14, the cup 14 is passed under a package compression device 62 that compressively communicates and affixes the wrapped package 12 to the package receiving surface 24 of the cup 14 as the adhesive sets. In the preferred embodiment, the compression device 62 includes a pair of skate wheels 64 extending downwardly from and pivotally mounted to a support structure 66 as shown in FIGS. 1–3. The skate wheels 64 apply a compressive force to the package 12 and cup 14 after the package 12 is secured to the package receiving surface 24 as the package 12 and cup 14 pass through the channel 46. In addition to the compressive force provided by the compression device 62, the package 12 is held in compressive communication with the cup 14 when the cups 14 are fully renested in region C as the cups 14 exit the channel 46. After the cups 14 exit the channel 46, the nested cups 14 are then ready for packaging and shipment to the desired location.

The apparatus 10 further includes a support structure(s), indicated generally at 70 in FIG. 1, used to support and properly position the holding bin 38, conveyor belt assembly 40, the rotatable applicator assembly 20, the threaded rollers 44, the adhesive applicator 58, and the package compression device 62. The support structure shown in FIG. 1 is set forth for illustrative purposes only, and can be modified or reconfigured so long as the above mentioned components of the apparatus 10 remain properly aligned.

The foregoing description is set forth only for illustrative purposes only and is not meant to be limiting. Numerous variations, within the scope of the appended claims will be apparent to those skilled in the art in light of the foregoing description and accompanying drawings.

Having thus described the invention, what is claimed and desired to be secured by Letters Patent is:

1. A method of applying wrapped packages to each cup associated with a nested stack of cups, comprising the steps of:

feeding the stack of cups through a channel so that an exterior side wall package receiving surface of each cup is facing upwardly as the cup passes through the channel;

partially denesting the cups in the channel to expose the package receiving surface of each cup;

retrieving a wrapped package from a pile of wrapped packages;

applying adhesive between the wrapped package and the package receiving surface of the cup;

transferring the wrapped package into alignment with the package receiving surface of the cup;

removably securing the wrapped package to the package receiving surface of the cup in the channel;

applying compressive force to the wrapped package after the wrapped package is applied to the cup; and renesting the cups in the channel.

2. The method as set forth in claim 1 wherein the step of applying adhesive between the wrapped package and the package receiving surface of the cup includes applying adhesive to the package receiving surface of each cup after the cup is denested and before the package is applied thereto.

3. The method as set forth in claim 1 wherein the step of applying adhesive between the wrapped package and the package receiving surface of the cup includes applying adhesive to a cup receiving surface associated with each wrapped package prior to the application of the package to the cup.

4. A method of successively applying wrapped packages to each cup associated with a nested stack of cups, comprising the steps of:

continuously feeding the stack of cups along a fixed path without rotating the cups;

partially denesting the cups to expose a portion of the outer surface of each cup without rotating the cups;

applying adhesive and a wrapped package to the exposed outer surface of each denested cup;

urging the wrapped package into engagement with the cup surface; and renesting the cups.

5. A method of applying wrapped packages to exterior side wall receiving surfaces of each cup associated with a nested stack of cups, comprising the steps of:

feeding a stack of nested cups to a denesting area;

maintaining the cups in a fixed rotational position whereby the exterior side wall package receiving surface of each cup is in a relatively upright position;

partially denesting the cups to expose the upright package receiving surface of each cup;

retrieving wrapped packages from a pile of wrapped packages;

applying adhesive between the retrieved wrapped package and the upright package receiving surface of each denested cup;

transferring the retrieved wrapped package into alignment with the upright package receiving surface of a denested cup;

removably securing the retrieved wrapped package to the upright package receiving surface of the denested cup;

applying compressive force to the wrapped package after the wrapped package is applied to the denested cup; and renesting the cups.

6. The method as set forth in claim 5 wherein the step of applying adhesive between the wrapped package and the package receiving surface of the cup includes applying adhesive to the package receiving surface of each cup after the cup is denested and before the package is applied thereto.

7. The method as set forth in claim 5 wherein the step of applying adhesive between the wrapped package and the package receiving surface of the cup includes applying adhesive to a cup receiving surface associated with each wrapped package prior to the application of the package to the cup.

* * * * *